US006929054B2

(12) United States Patent
Beals et al.

(10) Patent No.: US 6,929,054 B2
(45) Date of Patent: Aug. 16, 2005

(54) INVESTMENT CASTING CORES

(75) Inventors: James T. Beals, West Hartford, CT (US); Samuel D. Draper, Kohler, WI (US); Jose A. Lopes, Glastonbury, CT (US); Stephen D. Murray, Marlborough, CT (US); Brandon W. Spangler, Rocky Hill, CT (US); Michael K. Turkington, Manchester, CT (US); Bryan P. Dube, Columbia, CT (US); Keith A. Santeler, Middletown, CT (US); Jacob A. Snyder, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/741,710

(22) Filed: Dec. 19, 2003

(65) Prior Publication Data

US 2005/0133193 A1 Jun. 23, 2005

(51) Int. Cl.[7] ..... B22C 9/10

(52) U.S. Cl. ..... 164/369; 164/397; 164/365

(58) Field of Search ..... 164/369, 365, 164/397, 398, 399, 359; 428/586

(56) References Cited

U.S. PATENT DOCUMENTS

| | | | | |
|---|---|---|---|---|
| 4,487,246 | A * | 12/1984 | Frasier | 164/32 |
| 4,596,281 | A * | 6/1986 | Bishop | 164/32 |
| 4,811,778 | A * | 3/1989 | Allen et al. | 164/516 |
| 5,047,181 | A | 9/1991 | Occhionero et al. | |
| 5,296,308 | A | 3/1994 | Caccavale et al. | |
| 5,599,166 | A * | 2/1997 | Deptowicz et al. | 416/97 R |
| 6,119,761 | A * | 9/2000 | Anazawa et al. | 164/35 |
| 6,530,416 | B1 * | 3/2003 | Tiemann | 164/137 |
| 6,637,500 | B2 | 10/2003 | Shah et al. | |

* cited by examiner

*Primary Examiner*—Jonathan Johnson
*Assistant Examiner*—Len Tran
(74) *Attorney, Agent, or Firm*—Bachman & LaPointe, P.C.

(57) ABSTRACT

A sacrificial core for forming an interior space of a part includes a ceramic core element and a first core element including a refractory metal element. The ceramic core element may be molded over the first core element or molded with assembly features permitting assembly with the first core element.

23 Claims, 5 Drawing Sheets

INVESTMENT CASTING CORES

BACKGROUND OF THE INVENTION (1) Field of the Invention

The invention relates to investment casting. More particularly, it relates to the investment casting of superalloy turbine engine components.

(2) Description of the Related Art

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective.

Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

FIG. 1 shows a gas turbine engine 10 including a fan 11, compressor 12, a combustor 14, and a turbine 16. Air 18 flows axially through the sections 12, 14, and 16 of the engine 10. Air 18, compressed in the compressor 12, is mixed with fuel which is burned in the combustor 14 and expanded in the turbine 16, thereby rotating the turbine 16 and driving the compressor 12 and the fan 11 or other load.

Both the compressor 12 and the turbine 16 are comprised of rotating and stationary elements (blades and vanes) having airfoils 20 and 22, respectively. The airfoils, especially those in the turbine 16, are subjected to repetitive thermal cycling under widely ranging temperatures and pressures. To avoid thermal damage to the airfoils, each airfoil 20 includes internal cooling provided by internal passageways.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. This leaves the mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part (s). The part(s) can then be machined and treated in one or more stages.

The ceramic cores themselves may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned co-pending U.S. Pat. No. 6,637,500 of Shah et al. discloses general use of a ceramic and refractory metal core combination. There remains room for further improvement in such cores and their manufacturing techniques.

SUMMARY OF THE INVENTION

One aspect of the invention involves a sacrificial core for forming an interior space of a part. A first core element comprises a refractory metal element and has at least a first surface portion and has a second surface portion for forming an associated first surface portion of the interior space. A ceramic core element is molded over the first core element so as to have a first surface portion in contact with the first core element first surface portion and a second surface portion for forming an associated second surface portion of the interior space. The refractory metal element may be formed from sheet stock.

Another aspect of the invention involves a sacrificial core for forming an interior space of a part. A ceramic core element has a first surface portion for forming an associated first surface portion of the interior space. A refractory metal core element has a first surface portion for forming an associated second surface portion of the interior space. The refractory metal core element is non-destructively removably retained relative to the ceramic core element by elasticity of the refractory metal core element. The refractory metal core element may have first and second engagement portions elastically grasping the ceramic core element.

Another aspect of the invention involves a method for forming a metallic part having an interior space. A first core element is formed comprising a refractory metal element and having at least first and second surface portions. A ceramic core element is molded over the first core element to have a first surface portion engaging the first core element first surface portion and to have a second surface portion. Metal is cast over the combined first core element and ceramic core element. The second surface portions of the first core element and ceramic core element form associated surface portions of the part interior space. The combined first core element and ceramic core element are destructively removed.

In various implementations, a fugitive material may be applied to at least one of the first core element and the ceramic core element. The fugitive material may subsequently be at least partially driven out from between the first core element and ceramic core element. The formation of the first core element may involve forming the refractory metal element and then applying a ceramic coating to at least a portion of the refractory metal element so as to form at least the first core element first surface portion. The refractory metal element may be formed from sheet stock. The ceramic core element may be molded around a tab portion of the first core element at least partially forming the first surface of the first core element. The molding of the ceramic core element may involve engaging a third surface portion of the first core element to a mold so as to hold the first core element during introduction of ceramic molding material. The method may be used to form a turbomachine blade wherein the ceramic core element first surface forms essentially spanwise passageway portions of the interior space and the first core element first surface forms airfoil tip cooling passageway portions of the interior space. The method may be used to form a turbomachine airfoil wherein the ceramic core element first surface forms essentially spanwise passageway portions of the interior space and the first core element first surface forms airfoil leading edge cooling passageway portions of the interior space. The method may be used to form a turbomachine airfoil wherein the ceramic core element first surface forms essentially spanwise passageway portions of the interior space and the first core element first surface forms airfoil pressure side cooling passageway portions of the interior space extending from at least one of the essentially spanwise passageway portions. The method may be used to form a turbomachine airfoil wherein the ceramic core element first surface forms essentially spanwise portions of the interior space and the first core element first surface forms airfoil trailing edge cooling passageway portions of the interior space extending from a trailing one of the essentially spanwise passageway portions. The molding of the ceramic core element may involve at least one of freeze casting and low pressure injection molding.

Another aspect of the invention involves a method for forming a metallic part having an interior space. A sacrificial mold insert is provided having at least first and second surface portions. A ceramic core element is molded over the sacrificial mold insert to have a first surface portion engaging the sacrificial mold insert first surface portion and to have a second surface portion. The sacrificial mold insert is destructively removed. The ceramic core element is assembled with a first core element comprising a refractory metal element and having at least first and second surface portions. The first core element first surface portion engages the ceramic core element first surface portion. Metal is cast over the combined first core element and ceramic core element. The second surface portions of the first core element and ceramic core element form associated surface portions of the part interior space. The combined first core element and ceramic core element are destructively removed.

In various implementations, an interfitting of the first core element first surface portion and the ceramic core element first surface portion may include a portion of the first core element in a blind slot of the ceramic core element. The interfitting may include opposed portions of the first core element grasping the ceramic core element. The interfitting may include an aperture in the first core element capturing a projection of the ceramic core element or of an intervening insert in the ceramic core element. The destructive removal of the sacrificial mold insert may leave a slot in the ceramic core element. The slot may have a draft angle of 2° or less. The draft angle may be 1° or less. The assembling may involve applying a ceramic adhesive between the first core element first surface portion and the ceramic core element first surface portion. The assembling may be performed with the ceramic core element in a green condition and the assembled ceramic core element and first core element may then be cofired.

Another aspect of the invention involves a method for forming a metallic part having an interior space. A ceramic core element is molded to have a first surface portion and a second surface portion. The ceramic core element is assembled with a first core element comprising a refractory metal element. The first core element has a first surface portion for engaging the ceramic core element first surface portion and has a second surface portion. The assembling includes applying a ceramic adhesive at least partially between the ceramic core element and first core element first surface portions. The ceramic adhesive is hardened. Metal is cast over the combined first core element and ceramic core element. The second surface portions of the first core element and ceramic core element form associated surface portions of the part interior space. The combined first core element and ceramic core element are destructively removed.

In various implementations, the hardening may occur simultaneously with a firing of the ceramic core element. The hardening may occur in a premold heating of the combined first core element and ceramic core element after a firing of the ceramic core element.

Another aspect of the invention involves a method for forming a metallic part having an interior space. A first core element is provided comprising a refractory metal element and having at least first and second surface portions. A ceramic core element is molded to have a first surface portion and a second surface portion. The first core element is assembled to the ceramic core element so that the first core element first surface portion is accommodated facing the ceramic core element first surface portion. Metal is cast over the combined first core element and ceramic core element. The second surface portions of the first core element and ceramic core element form associated surface portions of the part interior space. The combined first core element and ceramic core element are destructively removed.

In various implementations, an adhesive material may be applied between the first surface portions of the first core element and the ceramic core element. The first core element and ceramic core element may be heated prior to the casting so as to harden the adhesive material. An interfitting of the first core element first surface portion and the ceramic core element first surface portion may include a portion of the first core element in a blind slot of the second core element. The interfitting may include opposed portions of the first core element grasping the ceramic core element. The interfitting may include an aperture in the first core element capturing a projection of the ceramic core element or of an intervening insert in the ceramic core element.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like

DETAILED DESCRIPTION

Figure 1:
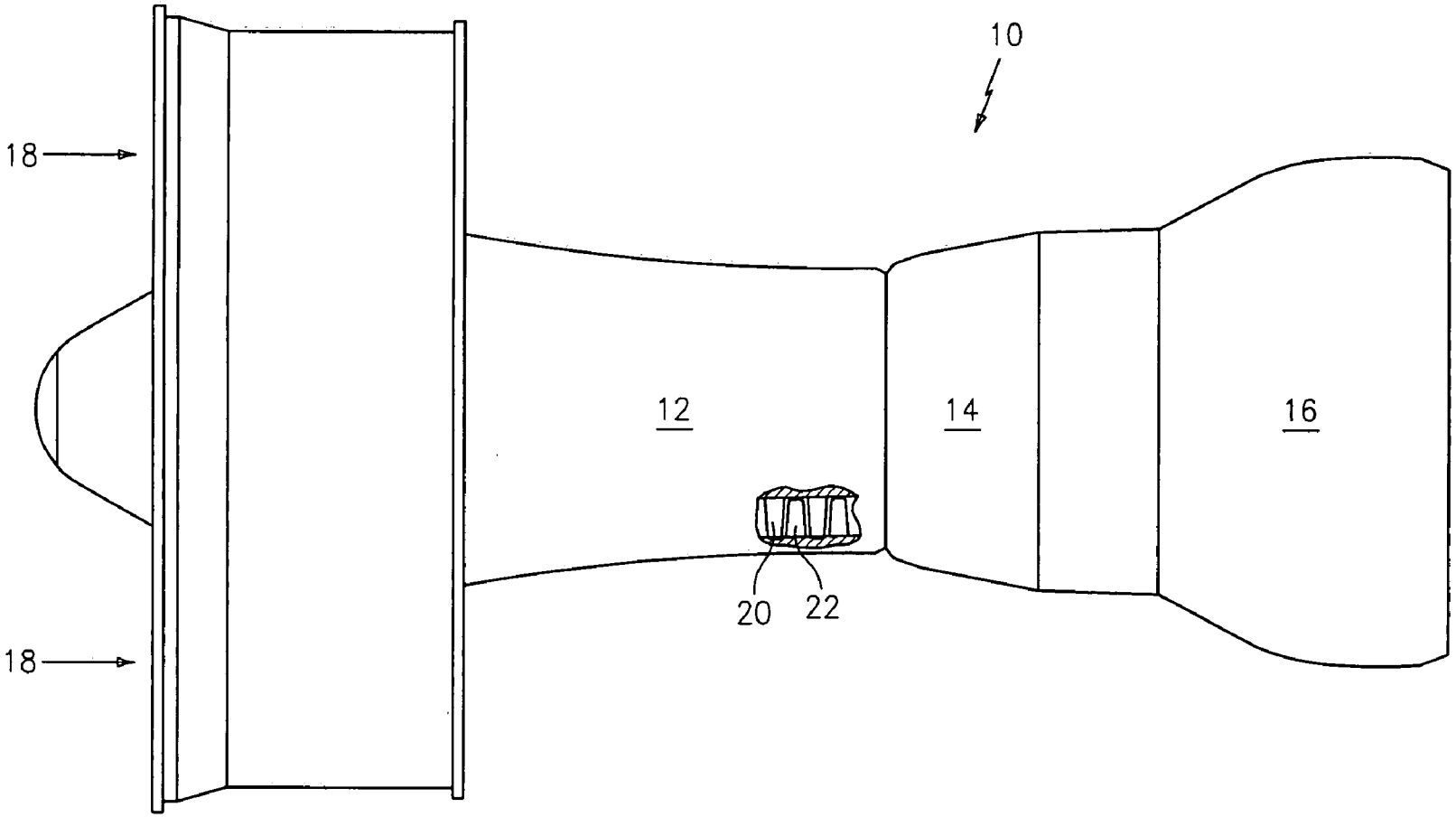
FIG. 1 is a schematic partially cut-away view of a gas turbine engine.
Figure 2:
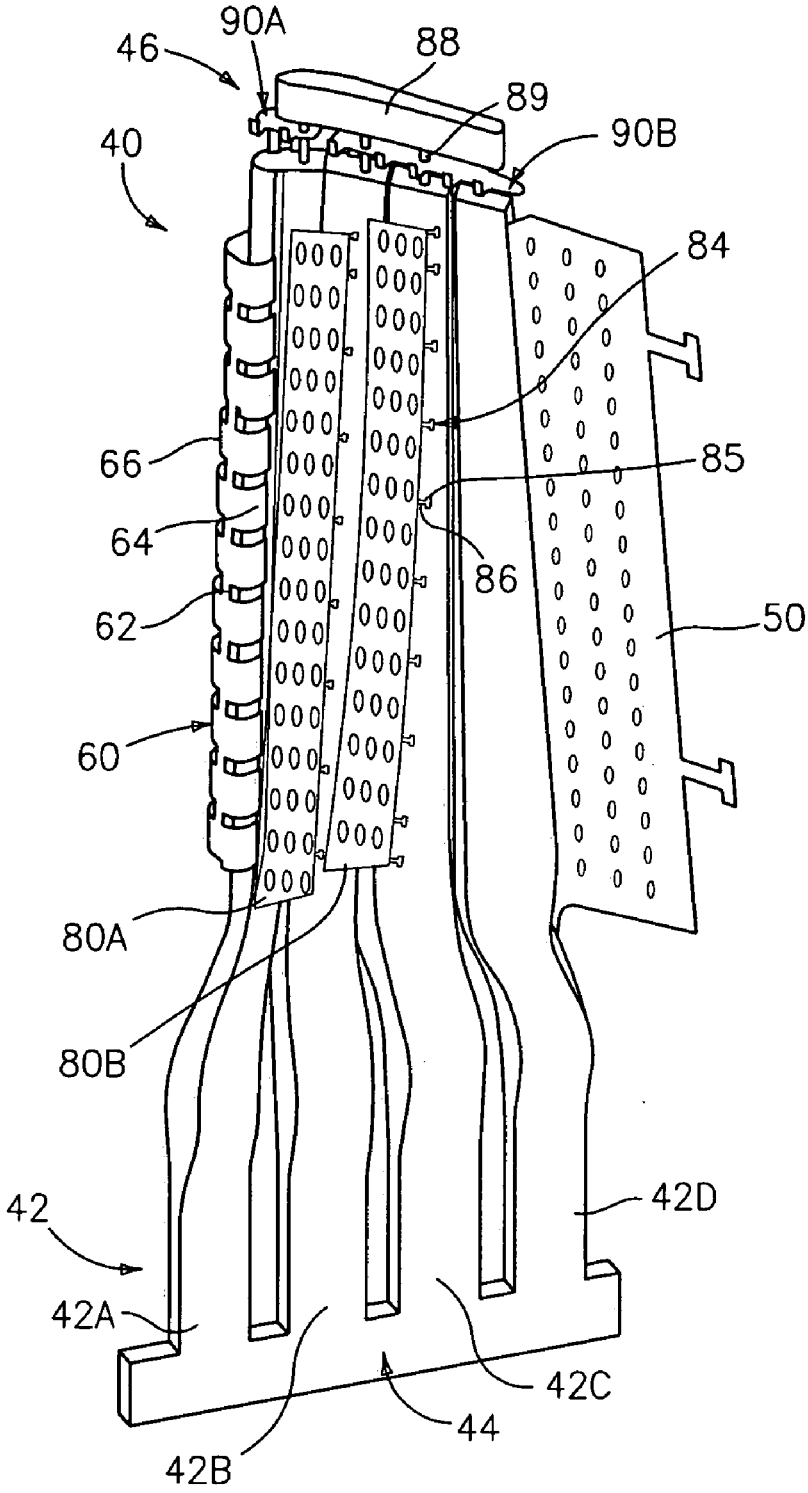
FIG. 2 is a view of a core combination for forming interior passageways of a turbine blade of the engine of FIG. 1.

FIG. 2 shows a blade-forming core 40 including a ceramic feed core 42. The ceramic feed core 42 may be formed in one or more pieces and may provide one or more passageways within the ultimate blade. In the exemplary embodiment, the feed core 42 has four main portions 42A–42D extending from a root area 44 to a tip area 46. In the exemplary embodiment, the leading and trailing portions 42A and 42D are separate from the middle portions 42B and 42C along a portion of the feed core associated with the airfoil of the blade. The core 40 further includes one or more refractory metal core (RMC) elements secured to the feed core portions. In the exemplary embodiment, a trailing RMC 50 extends from a leading edge embedded in a slot within a trailing region of the trailing feed core portion 42D to a trailing edge and has first and second surfaces associated with pressure and suction sides of the airfoil to be formed. In the exemplary embodiment, the trailing RMC 50 forms a trailing edge outlet slot in the ultimate airfoil. The exemplary RMC 50 has arrays of apertures that form pedestals spanning the slot between pressure and suction side portions of the airfoil to provide structural integrity, flow metering, and enhanced heat transfer. A trailing portion of the RMC 50 may be captured within the mold for forming the wax pattern and then protrudes from the pattern to be captured/secured within the ceramic shell formed over the pattern. The feed core may have additional positioning or retention features such as the projections of U.S. Pat. No. 5,296,308 of Caccavale et al. After wax removal and casting, the shell, feed core and RMC are destructively removed. Thereupon, the airfoil is left with the outlet slot as formed by the trailing RMC 50.

A leading RMC 60 is secured adjacent a leading region of the leading feed core portion 42A. In the exemplary embodiment, the leading RMC 60 has a central portion 62 and alternating tab-like pressure and suction side portions 64 and 66 extending therefrom. Tips of the tab-like portions 64 and 66 are captured within associated slots along the respective pressure and suction sides of the leading feed core portion 42A. In the exemplary embodiment, the leading RMC 60 may become entirely embedded within the wax pattern. It may thus form completely internal branches of the passageway system within the blade for cooling the blade leading edge region. To install the leading RMC 60, it may be elastically flexed to permit the tab-like portions 64 and 66 to pass over surface portions of the ceramic core and into the slots. In the installed position, the tab-like portions 64 and 66 may grasp the ceramic core with the leading RMC 60 under elastic stress. Alternatively, when in its installed position the leading RMC 60 may not be under stress. Elasticity of the leading RMC may, however, resist its removal/disengagement from the ceramic core, with elastic deformation permitting nondestructive removal. The leading RMC 60 may alternatively be installed via inelastic deformation (e.g., bending the tab-like portions 64 and 66) into the slots. A so-installed RMC might be nondestructively removeable by an at least partially reversed inelastic deformation.

In the exemplary embodiment, along their pressure sides, the leading and second feed core portions 42A and 42B bear main body RMCs 80A and 80B, respectively. Along the suction side of the leading core portion 42A, a third RMC 80C is borne. A fourth RMC 80D spans a gap between suction sides of the leading and second feed core portions. The main body RMCs have leading edge portions captured within slots in the associated feed core portions and extend in a downstream direction to trailing edge portions. The exemplary main body RMCs are formed so as to provide a number of serpentine passageways from the associated feed passageways to outlets on the pressure side surface of the airfoil. Accordingly, when the associated wax pattern is formed over the core 40, the trailing portions of the main body RMCs 80 and 82 will protrude from the pressure side surface of the airfoil of the pattern to ultimately form the outlet aperture holes from the blade airfoil pressure side surface. In the exemplary embodiment, the main body RMCs have a convoluted structure ahead of the trailing portions. The exemplary trailing portions are formed as tabs 84 having downstream/distal heads 85 connected to the convoluted intermediate portions via associated necks or stems 86. The heads 85 and, optionally, portions of the necks 86 protrude from the wax pattern and become embedded in the ceramic shell. After wax removal, these remain embedded in the shell to secure the RMC during the casting process. After casting and feed core and RMC removal, the airfoil is left with a convoluted passageway system provided by the RMCs and for which the pressure side outlet apertures and their adjacent outlet passageway portions are formed in place of the necks 86.

Figure 3:
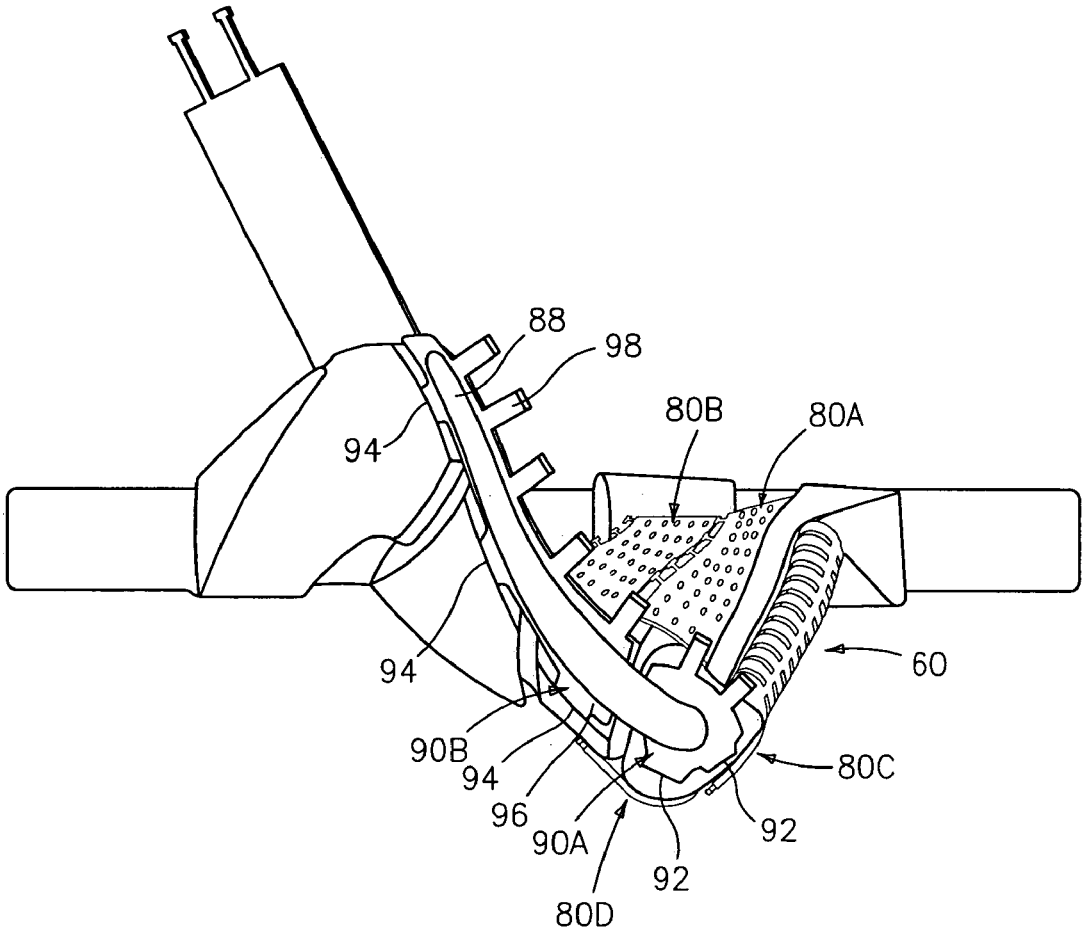
FIG. 3 is a tip view of the core of FIG. 2.

The core 40 further includes a tip ceramic core 88 for forming a tip or "squealer" pocket. The tip ceramic core 88 is spaced apart from the ends of the feedcore (e.g., by means of rods, such as circular cylindrical quartz rods 89, having first and second end portions respectively fully inserted in respective complementary blind compartments in the tip ceramic core and feedcore). An exemplary two tip RMCs 90A and 90B are formed at the tip of the feed core, between it and an inboard surface of the tip ceramic core. In the exemplary embodiment, the leading tip RMC 90A has tabs 92 (FIG. 3) embedded in slots in the tip surface of the leading feed core portion 42A. The exemplary downstream tip RMC 90B has more transversely elongate rail-like tabs 94 capture in rebates/shoulders in the associated tip surfaces of three downstream feed core portions 42B–42D. In the exemplary embodiment, each of the tip RMCs has a main body 96 offset parallel to and spaced-apart from the associated feed core portion tip surface(s) and held in such condition by cooperation of the tabs 92 and 94 with the respective slots and rebates/shoulders. Each further includes outward tabs/projections 98 which extend proximally parallel to the body and then distally outward. The projections 98 extend outward through the wax pattern for forming outlet passageways from such feed passageways with their distal portions serving to mount the core first within the wax pattern mold and then within the shell formed over such pattern. In the exemplary embodiment, the bodies 96 form plenums between the ends of the feed passageways provided by the feed core portions and the squealer pocket. Such plenums may connect such passageways to the extent the tip RMC spans multiple feed passageways. Such plenums are connected to the feed passageways by passageways formed by the tabs 92 and 94 and the inboard portions of the rods 89 and to the pressure side of the airfoil by passageways formed by the projections 98.

Figure 4:
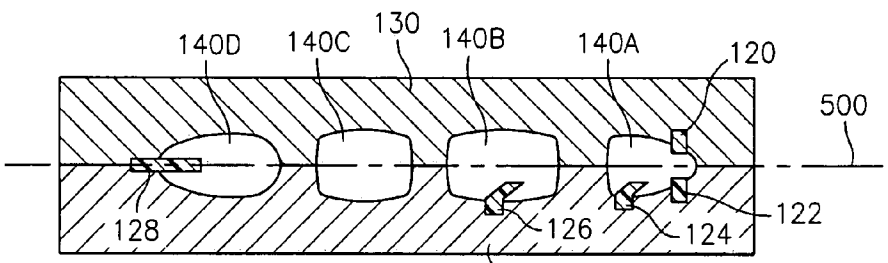
FIG. 4 is a partially schematic sectional view of a first feed core-forming mold.

A number of methods may be used to form the RMC attachment slots. Additionally, a number of other mounting means may be provided. The slots may be formed (e.g., cut) after feed core formation or during feed core formation. Examples of the former include laser cutting. In one example of preformed slots, FIG. 4 shows sacrificial inserts 120, 122, 124, 126, and 128 located in one or more portions 130 and 132 of a mold (or die) for forming the ceramic feed core. The inserts may be located along or off a mold parting plane or other contour 500 and may have portions mounted within associated mold portions and portions protruding into cavity portions 140A–140D (nominally corresponding to the feed core portions 42A–42D of the exemplary blade-forming embodiment). The inserts may be reusable, disposable, or sacrificial. A reusable insert would advantageously be configured so that, upon mold disassembly, it is initially pulled out of a first of the molded core or the associated mold portion and then could be removed from the second such as via extraction in a different direction than its extraction or removal from the first. Disposable inserts could be similarly configured. As abrasion and wear of the inserts may be a significant problem, even if removable it may be advantageous to make them disposable.

Sacrificial inserts, however, could be formed in additional ways. The inserts could be rupturable (e.g., being ruptured by opening of the mold). The sacrificial inserts could be sacrificed prior to mold opening (e.g., via melting). The sacrificial inserts could be sacrificed after mold opening (e.g., via melting during core firing or by chemical dissolving). In any event, the inserts may be dimensioned so that the ultimate fired slot or other feature has desired dimensions. One possible advantage of sacrificial inserts is in the forming of slots with very low draft angles. A removable insert could require a draft angle of 3–4° (e.g., facing surfaces of the slot diverging at such an angle from the base of the slot outward to facilitate insert removal). Beside the possibility of having lower draft angles (e.g., 0–2°), the use of sacrificial inserts may create alternative internal features to interlock a subsequently-inserted RMC to the feed core. Such features may include sockets for receiving spring-biased tabs (e.g., bent portions of a sheetstock RMC).

With highly abrasive, highly viscous feed core-forming material, a relatively high pressure molding may be required. This may potentially damage the inserts. Accordingly, it may be appropriate to use less viscous material with lower pressure molding. The ceramic material may be introduced at low pressure or even poured at ambient pressure into the mold. This may be followed by vibration or by vacuum assist to ensure complete filling of the mold. The low pressure filling may be used in conjunction with freeze casting. The freeze casting may provide a relatively low level of shrinkage in the cure/firing process. Freeze casting may also facilitate the pre-investment of portions of the RMCs in wax prior to the casting process so that the pre-investment protects fine cooling passage-forming features from contamination by the ceramic. Compared with high pressure molding utilizing pressures in the vicinity of 5–100 ksi, low pressure techniques may use substantially less pressure (e.g., less than 2 ksi) and optionally under vacuum assist. Exemplary early freeze casting techniques are described in U.S. Pat. No. 5,047,181 of Occhionero et al.

Other ways of pre-forming the slots involve molding the ceramic feed core around one or more of the RMCs. A number of considerations attend such molding. For example, the ceramic feed core-forming material may be relatively highly abrasive and may potentially damage an RMC. Additionally, volumetric changes associated with drying and firing the ceramic feed core in the presence of the partially embedded RMC may, along with differential thermal expansion of the RMC (during any transient heating/cooling process), produce mechanical stresses and potentially damage the feed core or the RMC. One method to address expansion/contraction problems is to provide a transient or fugitive accommodation to volume changes. Specifically, the feed core material may be such that the slot (or other mating feature) size contracts between the as-molded "green" state and a subsequent dried/fired state. Accordingly, a fugitive material (e.g., a meltable and/or viscous material such as a wax) may be applied at least to portions of the RMC that form the slot (or other feature) upon molding. The fugitive material may take the form of a full or partial coating or discrete pads or other pieces. The fugitive material thickness is selected to produce a green slot of dimensions that, upon drying and firing, contracts to a desired final dimension which appropriately engages the RMC. The drying and firing process may both simultaneously shrink the slot and drive off (either by melting, vaporizing, sublimating, squeezing out, or combinations thereof) the fugitive material.

Figure 5:
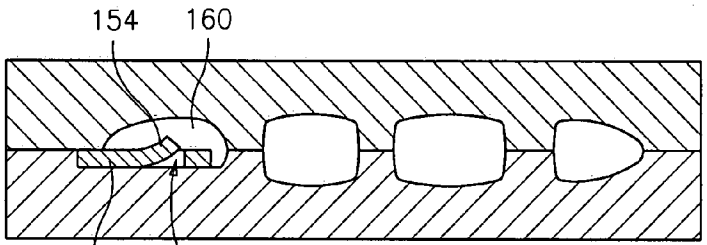
FIG. 5 is a partially schematic cross-sectional view of a second feed core-forming mold.
Figure 6:
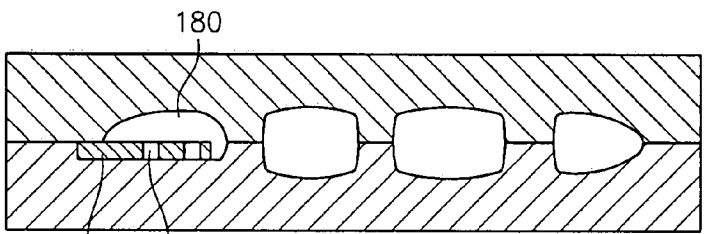
FIG. 6 is a partially schematic cross-sectional view of a third feed core-forming mold.
Figure 7:
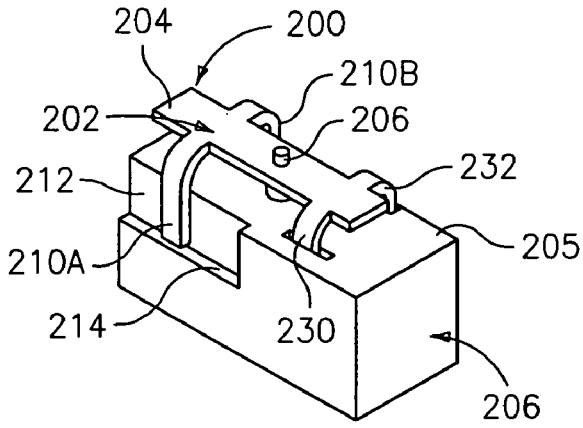
FIG. 7 is a view of a ceramic core and RMC combination showing a variety of exemplary attachment/registration features.
Figure 8:
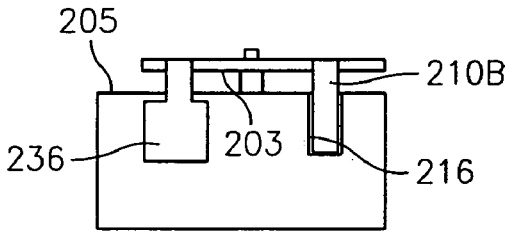
FIG. 8 is a side view of the combination of FIG. 7.
Figure 9:
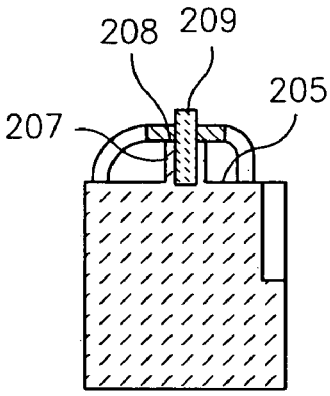
FIG. 9 is a transverse sectional view of the combination of FIG. 7 taken along line 9—9.

The low pressure molding techniques may also be used with various core overmolding techniques. FIG. 5 shows an RMC 150 partially perforated to form an aperture 152 from which a tab portion 154 is bent out of coplanar relationship to protrude into a cavity 160 into which ceramic molding material is introduced. FIG. 6 shows an RMC 170 having apertures 172 with at least one end along one surface of the core exposed to a cavity 180. Molding material introduced in cavity 180 flows into the apertures 172 to interlock and secure the RMC and feed core. The apertures 172 as shown are closed (i.e., are inboard of the perimeter of the RMC). Alternatively, apertures may be formed as channels extending inward from the RMC perimeter. The exemplary apertures are straight, however, they may be tapered for further interlocking. The exemplary apertures are exposed at only one side (face) of the RMC however, they could alternatively be exposed at both sides to provide a riveting-action. FIG. 7 shows several alternate RMC/feed core interlocking features. The illustrated RMC 200 has a main body 202 which has an inboard surface 203 (FIG. 8) and an outboard surface 204. The inboard surface 203 is spaced apart from a local principal outboard surface 205 of a ceramic core 206. For precise registry, a pedestal projection 206 extends from the ceramic core outboard surface and has a large diameter or cross-section proximal portion and a smaller diameter or cross-section distal portion separated by a shoulder. In an exemplary embodiment (FIG. 9) the proximal portion 207 is formed by a tubular neck unitarily-formed with the remainder of the ceramic core and extending outward from the surface 205 to a rim 208 that forms the shoulder. The distal portion is formed by a distal portion of a quartz rod 209 inserted within the tubular portion 207. The exemplary quartz rod provides a greater robustness than might a unitarily-formed ceramic pedestal projection. The distal portion extends through an aperture in the RMC body 202 with the shoulder engaging the body inboard surface/underside 203 to precisely register the body in a spaced-apart relationship with the ceramic core outboard surface 205. Further retention may be provided by a pair of elongate tabs or fingers 210A and 210B (FIG. 7) extending from the body and bent inward. Inboard surfaces of the fingers compressively engage base surfaces 212 of channels or rebates in adjacent lateral surfaces of the ceramic core. The rebate inboard surfaces may be angled to slightly converge away from the adjacent surface 205 so that a grasping action of the fingers retains the RMC against outward movement so that tips of the fingers engage shoulder surfaces 214 of the rebates. In the exemplary embodiment, the second finger 210B is shown captured within a relatively narrow rebate having lateral surfaces 216 that may further restraint movement of the RMC. At the other end of the exemplary RMC, are alternate fingers 230 and 232. The exemplary first finger 230 is received in a slot in the core outboard surface. The second finger 232 is received in a recessed area along the adjacent side of the core. The second finger 232 has a distal widened portion or protuberance 236 (FIG. 8) which is accommodated in the recess to be restrained against movement parallel to the second surface.

Figure 10:
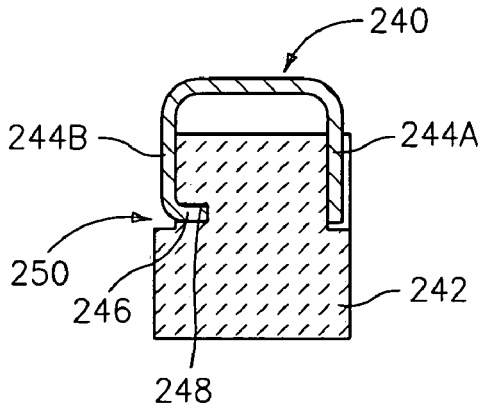
FIG. 10 is a sectional view of an alternate combination.

FIG. 10 shows yet an alternate RMC 240 and ceramic core 242 combination wherein the RMC has opposed fingers 244A and 244B. The exemplary finger 244A may be constructed similarly to the aforementioned fingers. The exemplary finger 244B is shown having an inwardly-directed tip portion 246 extending into a slot 248 which extends inward from the adjacent rebate 250. The capturing of the tip portion may provide further registration of the main body portion of the RMC 240 in directions toward and away from the ceramic core and transverse thereto. The foregoing mounting features are illustrative and may be used individually or in various combinations.

Figure 11:
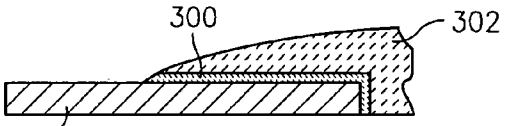
FIG. 11 is a schematic sectional view of a first trailing edge RMC and feed core combination.
Figure 12:
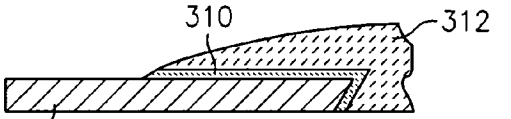
FIG. 12 is a schematic sectional view of a second trailing edge RMC and feed core combination.
Figure 13:
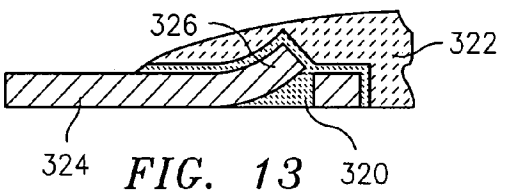
FIG. 13 is a schematic sectional view of a third trailing edge RMC and feed core combination.
Figure 14:
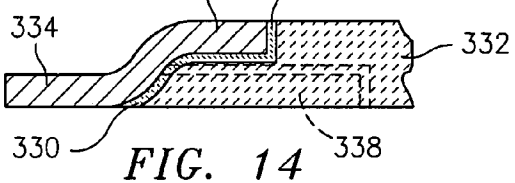
FIG. 14 is a schematic sectional view of a fourth trailing edge RMC and feed core combination.
Figure 15:
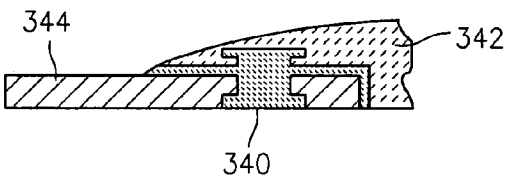
FIG. 15 is a schematic sectional view of a fifth trailing edge RMC and feed core ion.

Yet additional alternatives involve ceramic adhesives. The exemplary ceramic adhesive may initially be formed of a slurry comprising ceramic powder and organic or inorganic binders. With a binder combination, the organic binder(s) (e.g., acrylics, epoxies, plastics, and the like) could allow for improved room temperature strength of a joint while the inorganic binder(s) (e.g., colloidal silica and the like) may convert to ceramic(s) at a moderate temperature (e.g., 500C). Adhesives may be used to secure RMCs to preformed green cores or may be used to secure RMCs to fired ceramic cores. FIG. 11 shows a ceramic adhesive 300 intervening between a ceramic feed core 302 and an RMC 304 in a lap joint configuration as might be used for a trailing edge RMC. Such adhesive may be used in combination with further mechanical interlocking features. FIG. 12 shows an adhesive 310 in a dovetail back lock lap joint between a ceramic core 312 and an RMC 314. FIG. 13 shows an adhesive 320 intervening between a ceramic core 322 and an RMC 324 wherein the RMC has perforated tabs 326 for further securing. FIG. 14 shows an adhesive 330 between a ceramic core 332 and an RMC 334 wherein portions of the RMC are bent to form clip-like fingers 336 and 338 sandwiching portions of the core therebetween in offset fashion. An exemplary RMC 334 may easily be formed from sheet-stock. RMCs with non-offset fingers may be cast or machined or assembled from multiple sheet pieces or folded from a single sheet piece. FIG. 15 shows a situation wherein the adhesive 340 itself forms a physical interlocking feature such as a rivet-like structure connecting the ceramic core 342 to the RMC 344. The rivet-like structure may be single-headed (e.g., with that head captured in a complementary blind or open compartment in the RMC) or multi-headed (e.g., with an opposite second head captured in a complementary blind or open compartment of the ceramic core).

Exemplary RMC materials are refractory alloys of Mo, Nb, Ta, and W these are commercially available in standard shapes such as wire and sheet which can be cut as needed to form cores using processes such as laser cutting, shearing, piercing and photo etching. The cut shapes can be deformed by bending and twisting. The standard shapes can be corrugated or dimpled to produce passages which induce turbulent airflow. Holes can be punched into sheet to produce posts or turning vanes in passageways. Other configurations may be appropriate for casting non-airfoil turbomachine parts (e.g., combustor liners and blade outer air seals) and for non-turbomachine parts (e.g., heat exchangers).

Refractory metals are generally prone to oxidize at elevated temperatures and are also somewhat soluble in molten superalloys. Accordingly, the RMCs may advantageously have a protective coating to prevent oxidation and erosion by molten metal. These may include coatings of one or more thin continuous adherent ceramic layers. Suitable coating materials include silica, alumina, zirconia, chromia, mullite and hafnia. Preferably, the coefficient of thermal expansion (CTE) of the refractory metal and the coating are similar. Coatings may be applied by CVD, PVD, electrophoresis, and sol gel techniques. Individual layers may typically be 0.1 to 1 mil thick. Metallic layers of Pt, other noble metals, Cr, and Al may be applied to the RMCs for oxidation protection, in combination with a ceramic coating for protection from molten metal erosion.

Refractory metal alloys and intermetallics such as Mo alloys and $MoSi_2$, respectively, which form protective $SiO_2$ layers may also be used for RMCs. Such materials are expected to allow good adherence of a non-reactive oxide such as alumina. Silica though an oxide is very reactive in the presence of nickel based alloys and is advantageously coated with a thin layer of other non-reactive oxide. However, by the same token, silica readily diffusion bonds with other oxides such as alumina forming mullite.

For purposes of interpretation, metals containing solid solution strengtheners, precipitation strengtheners and dispersion strengtheners are regarded as alloys. Alloys of Mo include TZM (0.5% Ti, 0.08% 2r, 0.04% C, bal. Mo), and lanthanated Molybdenum Alloys of W include W-38% Re. These alloys are by way of example and are not intended to be limiting.

After the casting process is complete the shell and core assembly, are removed. The shell is external and can be removed by mechanical means to break the ceramic away from the casting, followed as necessary by chemical means usually involving immersion in a caustic solution to remove to core assembly. In the prior art, ceramic cores are usually removed using caustic solutions, often under conditions of elevated temperatures and pressures in an autoclave. The same caustic solution core removal techniques may be employed to remove the present ceramic cores. The RMCs may be removed from superalloy castings by acid treatments. For example, to remove Mo cores from a nickel superalloy, one may use an exemplary 40 parts $HNO_3$ 30 parts $H_2SO_4$, bal $H_2O$ at temperatures of 60–100° C. For refractory metal cores of relatively large cross-sectional dimensions thermal oxidation can be used to remove Mo which forms a volatile oxide. In Mo cores of small cross-sections, thermal oxidation may be less effective.

One or more embodiments of the present invention have been described. Nevertheless, it will be understood that various modifications may be made without departing from the spirit and scope of the invention. For example, the details of any particular element to be manufactured may influence the desired properties of the associated one or more ceramic core and one or more RMCs. Accordingly, other embodiments are within the scope of the following claims.

What is claimed is:

1. A sacrificial core for forming an interior space of a part, the core comprising:

a ceramic core element having a first surface portion for forming an associated first surface portion of the interior space; and a refractory metal core element having a first surface portion for forming an associated second surface portion of the interior space and nondestructively removeably retained relative to the ceramic core element by elasticity of the refractory metal core element, the refractory metal core element has first and second engagement portions elastically grasping the ceramic core element under elastic stress.

2. A sacrificial core for forming an interior space of a part, the core comprising:

a ceramic core element having a first surface portion for forming an associated first surface portion of the interior space; and a refractory metal core element having a first surface portion for forming an associated second surface portion of the interior space; and a rod, partially embedded in the ceramic core element, and extending through an aperture in the refractory metal core element.

3. The core of claim 2 wherein:

the rod is a quartz rod.

4. A sacrificial core for forming an interior space of a part, the core comprising:

a first core element comprising a refractory metal element and having at least a first surface portion and a second surface portion for forming an associated first surface portion of the interior space; and a ceramic core element having a first surface portion and having a second surface portion for forming an associated second surface portion of the interior space, the melded ceramic core element secured to the first core element by at least one of:

capturing of the first core element along the first core element first surface portion in a molded slot in the ceramic core element, the molded slot being formed by said ceramic core element first surface portion and having a draft angle of 2° or less; and a ceramic adhesive between the ceramic core element first surface portion and the first core element first surface portion.

5. The sacrificial core element of claim 4 wherein said ceramic adhesive is present and provides a mechanical backlocking with at least one of the ceramic core element and the first core element.

6. A sacrificial core for forming an interior space of a part, the core comprising:

a first core element comprising a refractory metal element and having at least a first surface portion and a second surface portion for forming an associated first surface portion of the interior space, the refractory metal element being formed from sheet stock and having an aperture from which a tab is bent out of coplanar relationship; and a ceramic core element engaging the first core element so as to have a first surface portion in contact with the first core element first surface portion and a second surface portion for forming an associated second surface portion of the interior space.

7. A sacrificial core for forming an interior space of a part, the core comprising:

a first core element comprising a refractory metal element and having at least a first surface portion and a second surface portion for forming an associated first surface portion of the interior space, the refractory metal element having an array of apertures for forming pedestals in an airfoil trailing edge outlet slot; and a ceramic core element engaging the first core element so as to have a first surface portion in contact with the first core element first surface portion and a second surface portion for forming an associated second surface portion of the interior space.

8. A sacrificial core for forming an interior space of a part, the core comprising:

a ceramic core element having a first surface portion for forming an associated first surface portion of the interior space; and a refractory metal core element having a first surface portion for forming an associated second surface portion of the interior space and nondestructively removeably retained relative to the ceramic core element by elasticity of the refractory metal core element, a portion of the refractory metal core element being in a blind slot of the ceramic core element.

9. A sacrificial core for forming an interior space of a part, the core comprising:

a ceramic core element having a first surface portion for forming an associated first surface portion of the interior space; and a refractory metal core element having a first surface portion for forming an associated second surface portion of the interior space and nondestructively removeably retained relative to the ceramic core element by elasticity of the refractory metal core element an aperture in the refractory metal core element capturing a projection of the ceramic core element or of an intervening insert in the ceramic core element.

10. A sacrificial core for forming an interior space of a part, the core comprising:

a ceramic core element having a first surface portion for forming an associated first surface portion of the interior space, the ceramic core having at least one slot; and a refractory metal core element having a first surface portion for forming an associated second surface portion of the interior space and nondestructively removeably retained relative to the ceramic core element by elasticity of the refractory metal core element, the refractory metal core element having a tab portion with a tip in the slot.

11. A sacrificial core for forming an interior space of a part, the core comprising:

a ceramic core element having a first surface portion for forming an associated first surface portion of the interior space, the ceramic core element having portions for forming a plurality of feed passageways in an airfoil; and a refractory metal core element having a first surface portion for forming an associated second surface portion of the interior space and nondestructively removeably retained relative to the ceramic core element by elasticity of the refractory metal core element, the refractory metal core element having first and second engagement portions elastically grasping a leading one of said ceramic core element portions.

12. A sacrificial core for forming an interior space of a part, the core comprising:

a ceramic core element having a first surface portion for forming an associated first surface portion of the interior space; and a refractory metal core element:

having at least one portion spaced-apart from the ceramic core element;

having a first surface portion for forming an associated second surface portion of the interior space; and nondestructively removeably retained relative to the ceramic core element by elasticity of the refractory metal core element.

13. The sacrificial core of claim 12 wherein:

the refractory metal core element is completely embedded in a wax pattern.

14. The sacrificial core of claim 12 wherein:

the ceramic core element has a plurality of portions including a leading portion; and the refractory metal core has a central portion and pressure and suction side portions, tips of the pressure and suction side portions engaging the ceramic core element leading portion along respective pressure and suction sides of the leading portion.

15. The sacrificial core of claim 12 wherein:

the ceramic core element has a plurality of portions including a leading portion; and the refractory metal core has a central portion and alternating pressure and suction side portions extending therefrom, tips of the pressure and suction side portions engaging the ceramic core element leading portion along respective pressure and suction sides of the leading portion.

16. The sacrificial core of claim 12 wherein:

the ceramic core element has a plurality of portions including a leading portion; and the refractory metal core has a central portion and alternating pressure and suction side portions extending therefrom, tips of the pressure and suction side portions being captured within associated slots along respective pressure and suction sides of the leading portion.

17. The core of claim 2 wherein:

the refractory metal core element is nondestructively removeably retained relative to the ceramic core element by elasticity of the refractory metal core element.

18. The core of claim 2 wherein:

the rod is partially embedded in a second ceramic core element.

19. The core of claim 2 wherein:

the refractory metal core element has at least one portion contacting the ceramic core element.

20. The core of claim 2 wherein:

the refractory metal core element has at least one portion captured in a slot in the ceramic core element.

21. The core of claim 2 wherein:

the refractory metal core element has at least two portions, each captured in an associated slot in the ceramic core element.

22. The core of claim 2 wherein:

the refractory metal core element has at least two portions, each captured in an associated rebate in the ceramic core element.

23. The core of claim 2 wherein:

the refractory metal core element has at least one portion captured in a rebate in the ceramic core element.

* * * * *

UNITED STATES PATENT AND TRADEMARK OFFICE

CERTIFICATE OF CORRECTION

PATENT NO. : 6,929,054 B2
APPLICATION NO. : 10/741710
DATED : August 16, 2005
INVENTOR(S) : James T. Beals et al.

It is certified that error appears in the above-identified patent and that said Letters Patent is hereby corrected as shown below:

In column 11, claim 4, line 39, "melded" should be deleted.

Signed and Sealed this

Twenty-fourth Day of April, 2007

JON W. DUDAS
*Director of the United States Patent and Trademark Office*